US006163966A

United States Patent [19]

Jackson et al.

[11] Patent Number: 6,163,966

[45] Date of Patent: Dec. 26, 2000

[54] SCORING TOOL

[76] Inventors: Richard L. Jackson, 1870 Golf View Dr., River Falls, Wis. 54022; John Stacy, 17825 2nd Ave., N., Plymouth, Minn. 55447

[21] Appl. No.: 09/320,569

[22] Filed: May 27, 1999

Related U.S. Application Data

[60] Provisional application No. 60/096,888, Aug. 17, 1998.

[51] Int. Cl.[7] ..... B26B 25/00

[52] U.S. Cl. ..... 30/365; 30/307

[58] Field of Search ..... 30/365, 307, 319, 30/172

[56] References Cited

U.S. PATENT DOCUMENTS

| | | | |
|---|---|---|---|
| 1,991,546 | 2/1935 | Czapar | 30/307 X |
| 2,295,317 | 9/1942 | Young . | |
| 2,601,450 | 6/1952 | O'Neill | 30/340 X |
| 2,677,180 | 5/1954 | Schierghofer . | |
| 2,684,533 | 7/1954 | Kern . | |
| 3,514,854 | 6/1970 | Norfleet . | |
| 5,074,045 | 12/1991 | Brookfield | 30/365 X |

*Primary Examiner*—Douglas D. Watts

*Attorney, Agent, or Firm*—Patent & Trademark Services; Joseph H. McGlynn

[57] ABSTRACT

A a scoring tool which can be used to aid in removing wallpaper. The tool has a hand grip to which is connected a pair of cutting wheels. The wheels are mounted in the lower portion of the hand grip so the wheels diverge away from each other.

10 Claims, 1 Drawing Sheet

SCORING TOOL

This application claims the benefit of U.S. Provisional Application No. 60/096,888 filed Aug. 17, 1998.

BACKGROUND OF THE INVENTION

This invention relates, in general, to scoring tools, and, in particular, to scoring tools for wallpaper removal.

DESCRIPTION OF THE PRIOR ART

In the prior art various types of scoring tools have been proposed. For example, U.S. Pat. No. 2,295,317 to Young discloses a roughing tool with a plurality of cutting wheels each of which has a plurality of teeth thereon.

U.S. Pat. No. 2,677,180 to Schierghofer discloses a cutter for wall coverings which has a single wheel with cutting teeth.

U.S. Pat. No. 2,684,533 to Kern discloses a cutter having two cutting wheels.

U.S. Pat. No. 3,514,854 to Norfleet discloses a scarifier which has a plurality of teeth, each of which has a plurality of teeth thereon.

SUMMARY OF THE INVENTION

The present invention is directed to a scoring tool which can be used to aid in removing wallpaper. The tool has a hand grip to which is connected a pair of cutting wheels. The wheels are mounted in the lower portion of the hand grip so the wheels diverge away from each other.

It is an object of the present invention to provide a new and improved scoring tool for aiding in the removal of wallpaper.

It is an object of the present invention to provide a new and improved scoring tool which is easy to use.

It is an object of the present invention to provide a new and improved scoring tool which will move easily in a pivoting motion.

These and other objects and advantages of the present invention will be fully apparent from the following description, when taken in connection with the annexed drawings.

DESCRIPTION OF THE PREFERRED EMBODIMENT

Figure 1:
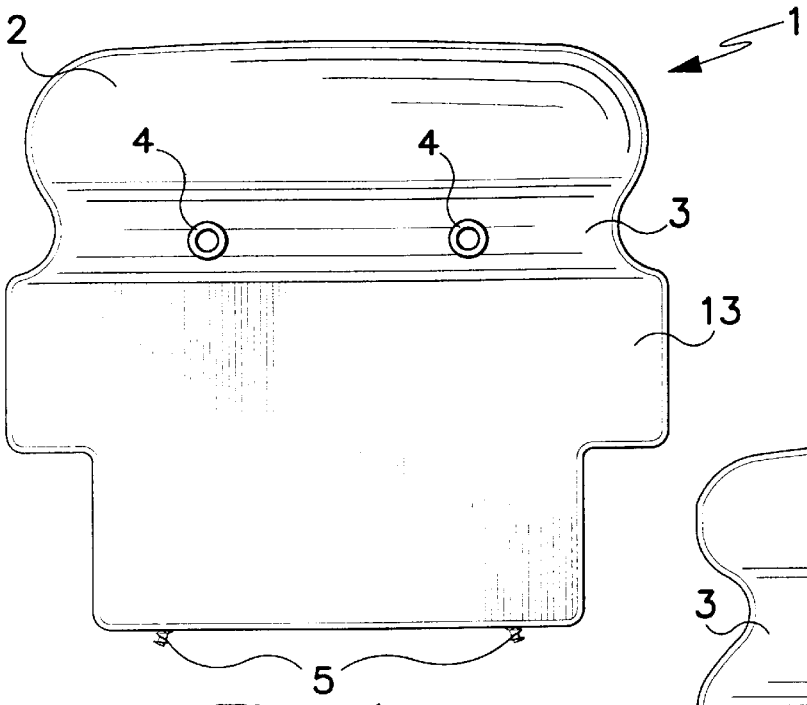
FIG. 1 is a side view of the present invention.

Referring now to the drawings in greater detail, FIG. 1 shows the scoring tool 1 of the present invention. The tool is designed to puncture wallpaper that is to be removed from a wall. The punctures in the wallpaper allow a solution, that will loosen the glue that holds the wallpaper, to penetrate through the wallpaper and reach the underlying glue. This tool will also be useful if there are more than one layer of wallpaper or if the wallpaper has been painted over, since in these instances it will be harder for the removal solution to reach the underlying glue.

Figure 2:
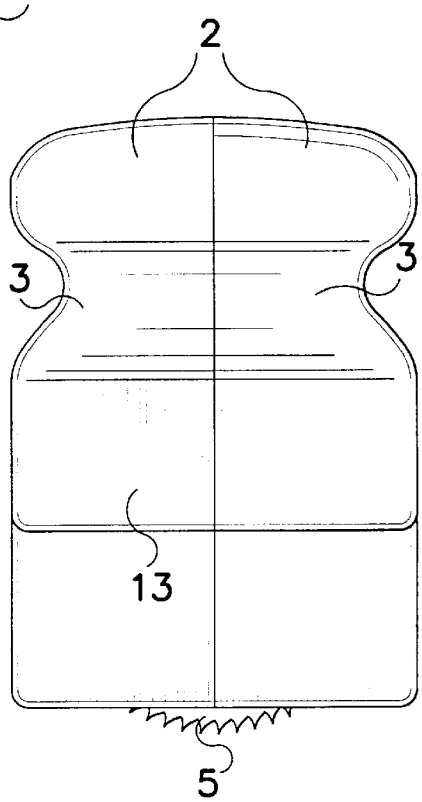
FIG. 2 is an end view of the present invention.

The tool 1 is made in two identical housing halves 2, as shown in FIG. 2, which will be held together by screws or bolts (not shown) passing through apertures 4. Each of the housing halves 2 have a groove 3 which provides a place for the user to position their fingers as they are using the tool. The groove will position the user's fingers away from the cutting blades 5. In addition, projection 13 also serves to protect the user's fingers from the cutting blades.

Figure 4:
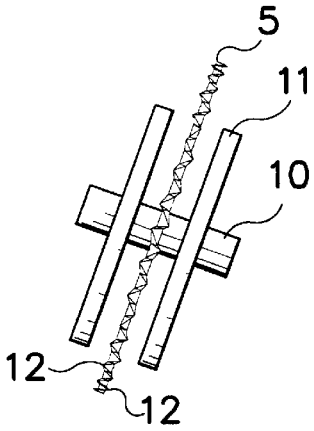
FIG. 4 is a partial view of the scoring wheels of the present invention.

At the bottom of the housing halves 2 are positioned two cutting or scoring wheels 5. Each of the wheels 5 are fashioned as saw blades with a plurality of teeth 12 positioned around the periphery, as shown in FIGS. 2 and 4. As can be clearly seen in FIG. 4, the teeth 12 are alternatingly set to the right and left of an imaginary center line passing through the plane of the circular blade. This alternating set of the teeth will allow clearance when cutting, and, in addition, they will provide a wider array of holes in the paper than if the blades were positioned inline. That is, since the teeth are offset each tooth will make a hole to one side of the center line of the blade and the next tooth will make a hole to the opposite side of the center line of the blade. If all the teeth were aligned, the holes would be inline or even overlap.

Figure 3:
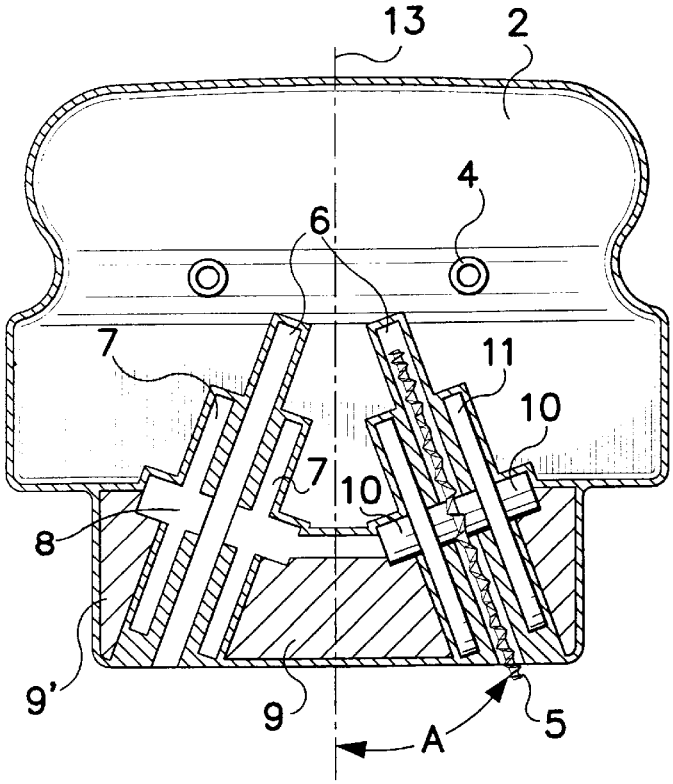
FIG. 3 is a view of the present invention showing the internal shape of the tool.

In addition, as seen in FIG. 3, the blades 5 are inclined with respect to the longitudinal center line of the housing halves 2. The preferred inclination A is 20° from the center line 13 of the housing half 2. The angle that each blade makes to the perpendicular is reversed so that the blades 5 diverge away from each other as they exit the bottom of the housing halves 2. This design allows the blades to rotate freely without interference which would occur if the blades 5 were parallel. Also, the geometry of the blades allow the tool 1 a pivoting rotation as the user moves the tool over the wall.

As shown in FIG. 4, each blade 5 is mounted on an axle 10 and held on the axle by flanges 11. It should be noted that the blades could be permanently mounted on the axle by making the flanges fixed to the axle, or the blades 5 could be made removable by making at least one of the flanges 11 removable.

As shown in FIG. 3, each blade is mounted in a lower portion of the housing halves 2 so the blades project approximately ⅛ inch from the bottom of the housing. Each of the housing halves 2 have a recess 6 to receive the blade and allow it to rotate. In addition, the housing halves each have recesses 7 to receive the flanges 11, and supports 9, 9' to support the axle 10.

Although the Scoring Tool and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A scoring tool comprising:

a pair of housing halves adapted to be joined together, said housing halves, when joined, supporting a pair of blades, each blade having a plurality of teeth disposed thereon, said plurality of teeth positioned on each said blade so alternating teeth are positioned toward opposite sides of said blade, and wherein each said housing half has a groove in an outer surface which extends from one end to another end of each of said housing halves, and wherein each said housing half has a projection positioned between said groove and a lower portion of each said housing half.

2. The scoring tool as claimed in claim 1, wherein said blades are positioned in said housing halves so they diverge away from each other as they extend from a bottom of said housing halves.

3. The scoring tool as claimed in claim 2, wherein each said blade extends away from a longitudinal center line of said housing halves approximately 20°.

4. The scoring tool as claimed in claim 1, wherein each said housing half has a projection positioned adjacent a lower portion of each said housing half.

5. The scoring tool as claimed in claim 1, wherein each said blade is mounted on an axle, and a pair of flanges are attached to said axle on opposite sides of said blade.

6. The scoring tool as claimed in claim 1, wherein each said housing half has a recess for receiving each said blade.

7. The scoring tool as claimed in claim 6, wherein each said housing half has recesses for receiving said flanges.

8. The scoring tool as claimed in claim 6, wherein each said housing half has projections for supporting said axles.

9. A scoring tool comprising:

a pair of housing halves adapted to be joined together, said housing halves, when joined together having a longitudinal axis extending from a top of said housing halves to a bottom of said housing halves, said housing halves, when joined, supporting a pair of blades, each blade having a plurality of teeth disposed thereon, said plurality of teeth positioned on each said blade so alternating teeth are positioned toward opposite sides of said blade, and wherein each said blade is contained within a respective plane, each of said respective planes making an acute angle with respect to said longitudinal axis, wherein each said housing half has a projection positioned adjacent a lower portion of each said housing half, and wherein each said housing half has a projection positioned between said groove and a lower portion of each said housing half.

10. A scoring tool comprising:

a pair of housing halves adapted to be joined together, said housing halves, when joined together having a longitudinal axis extending from a top of said housing halves to a bottom of said housing halves, said housing halves, when joined, supporting a pair of blades, each blade having a plurality of teeth disposed thereon, said plurality of teeth positioned on each said blade so alternating teeth are positioned toward opposite sides of said blade, and wherein each said blade is contained within a respective plane, each of said respective planes making an acute angle with respect to said longitudinal axis, and wherein each said blade is mounted on an axle, and a pair of flanges are attached to said axle on opposite sides of said blade.

* * * * *